US006726584B2

(12) United States Patent
Iggulden

(10) Patent No.: US 6,726,584 B2
(45) Date of Patent: Apr. 27, 2004

(54) METHOD AND APPARATUS FOR TEMPORARILY MARKING A POINT OF CONTACT

(76) Inventor: Jerry Iggulden, 10345 W. Olympic Blvd., Santa Barbara, CA (US) 90064

( * ) Notice: Subject to any disclaimer, the term of this patent is extended or adjusted under 35 U.S.C. 154(b) by 0 days.

(21) Appl. No.: 10/055,532

(22) Filed: Jan. 22, 2002

(65) Prior Publication Data

US 2003/0139234 A1 Jul. 24, 2003

(51) Int. Cl.[7] ..... L63B 39/06; L63B 69/38
(52) U.S. Cl. ..... 473/606; 473/577
(58) Field of Search ..... 473/570, 577, 473/606, 593, 594

(56) References Cited

U.S. PATENT DOCUMENTS

| | | | | | |
|---|---|---|---|---|---|
| 4,065,126 | A | * | 12/1977 | Mantz | 473/462 |
| 4,109,911 | A | | 8/1978 | Van Auken | |
| 4,538,811 | A | | 9/1985 | Wigoda | |
| 4,596,392 | A | * | 6/1986 | Walker | 473/280 |
| 4,637,616 | A | * | 1/1987 | Whiting | 473/577 |
| 4,718,670 | A | | 1/1988 | Gray | |
| 4,739,989 | A | * | 4/1988 | Prinz et al. | 473/606 |
| 4,830,370 | A | * | 5/1989 | Schlesinger | 473/577 |
| 4,886,275 | A | * | 12/1989 | Walker | 473/280 |
| 4,995,613 | A | * | 2/1991 | Walker | 473/280 |
| 5,394,824 | A | | 3/1995 | Johnson, Jr. | |
| 5,551,688 | A | * | 9/1996 | Miller | 473/570 |
| 5,823,891 | A | | 10/1998 | Winskowicz | |
| 6,066,689 | A | * | 5/2000 | Columbus et al. | 524/322 |
| 6,145,441 | A | * | 11/2000 | Woodall et al. | 102/502 |

FOREIGN PATENT DOCUMENTS

| | | | | |
|---|---|---|---|---|
| DE | 3904458 A1 | * | 8/1990 | A63B/71/06 |

* cited by examiner

*Primary Examiner*—Steven Wong
(74) *Attorney, Agent, or Firm*—Blakely Sokoloff Taylor & Zafman, LLP

(57) ABSTRACT

An encapsulated marking agent is used to provide a temporary mark at a point of contact between two objects. In a specific example, a game ball is coated with a temporary marking agent that is encapsulated or otherwise sealed against exposure to the air. When the ball contacts a surface with sufficient velocity, a small quantity of the marking agent is liberated to provide a visible mark on the surface at the point of contact. Similar to a "disappearing ink", the marking agent dissipates upon exposure to air.

5 Claims, 1 Drawing Sheet

METHOD AND APPARATUS FOR TEMPORARILY MARKING A POINT OF CONTACT

BACKGROUND OF THE INVENTION

1. Field of the Invention

This invention relates generally to the field of indicating a point of contact between two objects. In a particular embodiment, the invention relates to a ball treated so as to leave a transient visible mark at the point of contact with a surface.

2. Background

A number of games, particularly tennis, are played on a court marked with boundary lines. During playing of the game, it is important to know when a ball lands outside of the boundary lines since this will affect the scoring of the game. In games where the ball is traveling at high speed, it is frequently difficult to visually determine if the ball has landed "in" or "out" of bounds. Line judges are typically employed in professional matches to make such determination. Their calls are important to the outcome of the game and often incite heated reaction from the players and spectators.

A number of methods and systems have been proposed for automatically determining whether a game ball, particularly a tennis ball, is "in" or "out". Many of these require specially prepared courts and/or sophisticated tracking equipment. A system described in U.S. Pat. No. 4,109,911 utilizes a ball with a chemically treated surface that provides a transient indication when it contacts a chemically treated court surface. Thus, even this system requires a specially prepared court.

SUMMARY OF THE INVENTION

The present invention provides a game ball with a transient marking feature that may be used on any court surface. No preparation of the court surface is required. The game ball is coated with a temporary marking agent that is encapsulated or otherwise sealed against exposure to the air. When the ball contacts a surface with sufficient velocity, a small quantity of the marking agent is liberated to provide a visible mark on the surface at the point of contact. Similar to a "disappearing ink", the marking agent dissipates upon exposure to air.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
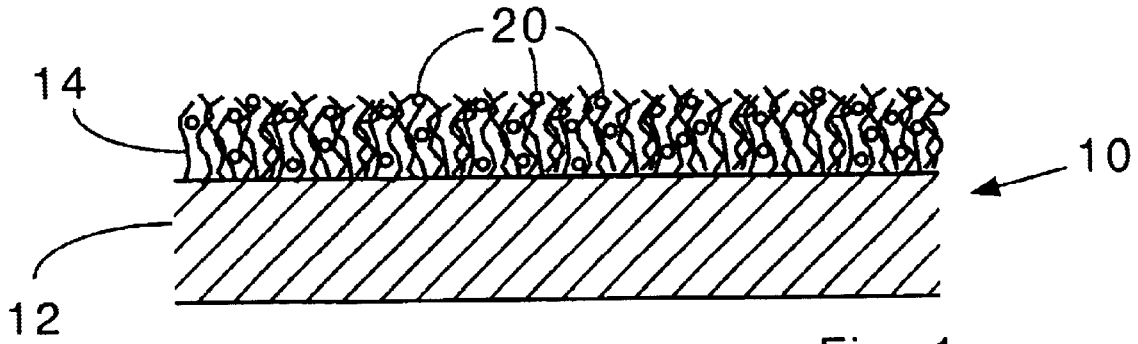
FIG. 1 is a magnified cross-sectional view of a game ball treated in accordance with a first embodiment of the present invention.

FIG. 1 is a magnified cross-sectional view of a tennis ball 10. In accordance with conventional tennis ball construction, ball 10 has a spherical rubber core 12 covered with felt 14. In one embodiment of the present invention, microcapsules 20 are dispersed within the felt. Microencapsulation is widely used as a packaging technique for a variety of volatile substances. The principles and techniques of microencapsulation are well known. Microcapsules 20 contain a marking agent similar to a "disappearing ink". One such marking agent that is commonly used for "disappearing ink" is thymolphthalein, which is colorless in an acidic solution, but is blue in a basic solution. When a slightly basic solution of thymolphthalein (soluble in alcohol) is exposed to air, the carbon dioxide in the air reacts with the solution, thereby decreasing the pH of the solution and turning the thymolphthalein colorless.

Microcapsules 20 are adhered to the fibers of felt 14 with a suitable adhesive. In order to avoid "matting" of the felt, it is preferred that the microcapsules be coated with a heat- or radiation-activated adhesive. The ball 10 may then be tumbled in the coated microcapsules, which are naturally captured in the nap of the felt, and subsequently exposed to the appropriate heat or radiation to activate the adhesive.

Microcapsules 20 are preferably formed so that they will rupture only upon a substantial impact. Thus, ball 10 may be subjected to normal handling and may even be bounced by hand on pavement without rupturing the microcapsules. However, when ball 10 strikes the court surface during play, the impact is sufficient to rupture a quantity of microcapsules 20, thereby depositing the marking agent on the court surface and, in the case of thymolphthalein, leaving a temporary blue mark. It will be appreciated that a blue or other colored marking agent will generally be visible anywhere on the playing court surface. If desired, a white or yellow marking agent may be employed, which will leave a higher visibility mark away from the boundary lines of the court, but will generally not leave an easily visible mark on the boundary lines themselves.

Figure 2:
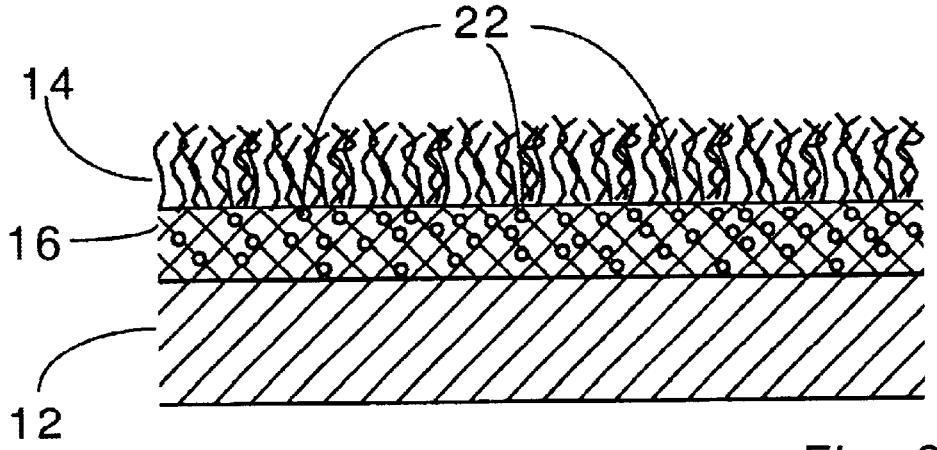
FIG. 2 is a magnified cross-sectional view of a game ball treated in accordance with another embodiment of the present invention.
Figure 3:
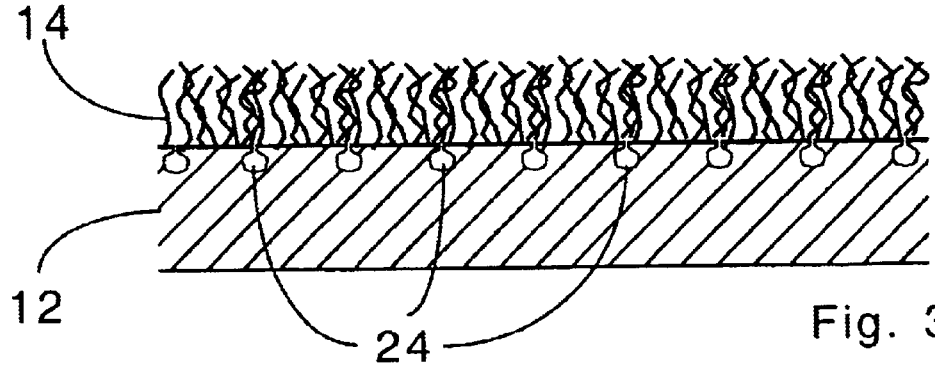
FIG. 3 is a magnified cross-sectional view of a game ball treated in accordance with yet another embodiment of the present invention.

The marking agent may be applied to ball 10 by means other than microencapsulation. For example, as shown in FIG. 2, a layer of material 16 may be interposed between the rubber core 12 and the felt 14. Material 16 incorporates microreservoirs 22, which are filled with a marking agent. Material 16 thus functions something like a sponge to retain the marking agent until it is released upon impact. In this embodiment, rubber core 12 is necessarily made somewhat smaller than a conventional tennis ball core to accommodate the additional thickness of material 16. Alternatively, as shown in FIG. 3, the rubber core 12 itself may be constructed to incorporate microreservoirs 24 containing the marking agent.

It is desirable that ball 10 be treated with the encapsulated marking agent at the time of manufacture. However, an encapsulated marking agent may be applied to a conventional ball by the consumer using an "aftermarket" product. For example, the microcapsules may be suspended within a liquid in which they are non-soluble. The consumer then simply immerses a conventional ball within the liquid and allows it to dry. The liquid is formulated as an adhesive so that the microcapsules adhere to the felt 16. Alternatively, a suspension of microcapsules may be supplied to the consumer as a spray-on product. It should be noted that these "aftermarket" products may be used by the consumer not only to treat conventional balls, but also to replenish the supply of microcapsules on balls that have already been treated by the manufacturer.

Although the present invention has been described primarily in the context of a tennis ball, it may also be embodied in other forms. For example, a marking agent may be applied to other types of sport balls used in court games. Furthermore, the marking agent of the present invention is useful for other applications where it is desired to ascertain the point of contact between two objects. For example, a suspension of microcapsules may be sprayed or otherwise applied to the surface of a golf club or baseball bat as a means for evaluating and improving a player's swing.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An improved tennis ball comprising:

a ball having a felted outer surface; and a plurality of microcapsules adhered to the felted outer surface, the microcapsules containing a marking agent that leaves a temporarily visible mark upon a surface struck by the ball.

2. The improved tennis ball of claim 1 wherein the marking agent comprises thymolphthalein.

3. The improved tennis ball of claim 1 wherein microcapsules containing the marking agent are adhered to the felted outer surface with an adhesive.

4. The improved tennis ball of claim 3 wherein the adhesive is a heat-activated adhesive.

5. The improved tennis ball of claim 3 wherein the adhesive is a radiation-activated adhesive.

* * * * *